US009745772B2

(12) United States Patent
Chen

(10) Patent No.: US 9,745,772 B2
(45) Date of Patent: Aug. 29, 2017

(54) BACK-TYPE EXPANDING AND OPENING FOLDABLE SUNSHADE APPARATUS

(71) Applicants: Guofan Chen, Foshan, Guangdong Province (CN); Wuhua Zhu, Foshan, Guangdong Province (CN)

(72) Inventor: Guofan Chen, Foshan (CN)

(73) Assignees: Guofan Chen, Foshan, Guangdong Province (CN); Wuhua Zhu, Foshan, Guangdong Province (CN)

( * ) Notice: Subject to any disclaimer, the term of this patent is extended or adjusted under 35 U.S.C. 154(b) by 0 days.

(21) Appl. No.: 15/025,572

(22) PCT Filed: Aug. 29, 2014

(86) PCT No.: PCT/CN2014/085569

§ 371 (c)(1),
(2) Date: Mar. 29, 2016

(87) PCT Pub. No.: WO2015/043360

PCT Pub. Date: Apr. 2, 2015

(65) Prior Publication Data

US 2016/0237715 A1 Aug. 18, 2016

(30) Foreign Application Priority Data

Sep. 30, 2013 (CN) ..... 2013 2 0615574 U

(51) Int. Cl.
*E04H 15/02* (2006.01)
*A45B 11/02* (2006.01)
(Continued)

(52) U.S. Cl.
CPC ..... *E04H 15/02* (2013.01); *A45B 11/00* (2013.01); *A45B 11/02* (2013.01); *A45B 17/00* (2013.01);
(Continued)

(58) Field of Classification Search
CPC . A45B 17/00; A45B 2200/1009; A45B 11/02; A45B 2011/005; A45B 11/00; A47C 4/286; A47C 3/0255; A47C 7/62; E04H 15/02; E04H 15/48; E04H 15/58; E04H 15/36; E04H 15/28; E04H 15/46; A45F 3/04; A45F 2003/003; A45F 3/10

(56) References Cited

U.S. PATENT DOCUMENTS 4,112,957 A 9/1978 Biven
4,836,231 A * 6/1989 Peterson ..... A45B 17/00 135/117

(Continued)

OTHER PUBLICATIONS

Abstract of Chinese Patent—CN203505770U, Apr. 2, 2014, 2 pages.

(Continued)

*Primary Examiner* — Winnie Yip
(74) *Attorney, Agent, or Firm* — Dority & Manning, P.A.

(57) ABSTRACT

Disclosed is a back-type expanding and opening foldable sunshade apparatus. The back-type expanding and opening foldable sunshade apparatus can be used directly on the back of a person or used together with a backpack by placing in the backpack, can adjust the opening extent and position of the shade in a lockable manner, and the width of the shade is expanded transversely when opening, thereby shading more effectively; and during use, the shade can be quickly opened, and when being not in use, the shade can be easily folded into a small device on the back or concealed in an interlayer of a backpack, thus being convenient and attractive.

9 Claims, 4 Drawing Sheets

(51) Int. Cl.

| | |
|---|---|
| ***A45B 19/00*** | (2006.01) |
| ***A45F 3/10*** | (2006.01) |
| ***E04H 15/46*** | (2006.01) |
| ***A45B 17/00*** | (2006.01) |
| *A45B 11/00* | (2006.01) |
| *A45B 23/00* | (2006.01) |
| *A45F 3/00* | (2006.01) |

(52) U.S. Cl.
CPC ..... *A45B 19/00* (2013.01); *A45B 23/00* (2013.01); *A45F 3/10* (2013.01); *E04H 15/46* (2013.01); *A45B 2011/005* (2013.01); *A45B 2023/0006* (2013.01); *A45B 2023/0025* (2013.01); *A45B 2023/0093* (2013.01); *A45B 2200/1009* (2013.01); *A45F 2003/003* (2013.01); *A45F 2200/05* (2013.01)

(58) Field of Classification Search
USPC .... 135/15.11, 16, 15, 21, 20.1, 20.3, 90, 96, 135/132–133, 117; 297/184.1, 184.16; 224/186–187, 190
See application file for complete search history.

(56) References Cited

U.S. PATENT DOCUMENTS

| | | | | |
|---|---|---|---|---|
| 5,896,590 | A * | 4/1999 | Fleisch | A42B 3/322 2/410 |
| 6,024,264 | A * | 2/2000 | Java | A45B 3/00 135/16 |
| 6,076,539 | A | 6/2000 | Richardson | |
| 7,861,735 | B2 * | 1/2011 | Stepaniuk | A61G 5/10 135/66 |
| 8,690,470 | B2 * | 4/2014 | Cash | A47C 7/66 135/16 |
| 8,944,300 | B1 * | 2/2015 | Kaufman | A45B 11/02 135/16 |
| 9,375,060 | B1 * | 6/2016 | Bagramyan | A45B 11/02 |
| 9,451,830 | B1 * | 9/2016 | Buzzella | A47C 7/66 |
| 9,498,012 | B1 * | 11/2016 | Rizk | A42B 1/201 |
| 2006/0219279 | A1 * | 10/2006 | Kaufman | A45B 11/02 135/20.1 |
| 2007/0262103 | A1 * | 11/2007 | Blakley | A45B 11/02 224/190 |
| 2010/0313922 | A1 * | 12/2010 | Raider | A45B 11/02 135/16 |
| 2013/0098410 | A1 * | 4/2013 | Prasannakumar | A45B 11/00 135/16 |

OTHER PUBLICATIONS

Abstract of Chinese Patent—CN203505772U, Apr. 2, 2014, 1 page.
Abstract of Japanese Patent—JP2010187724A, Sep. 2, 2010.
International Search Report for PCT/CN2014/085569, dated Nov. 24, 2014, 2 pages.

* cited by examiner

BACK-TYPE EXPANDING AND OPENING FOLDABLE SUNSHADE APPARATUS

CROSS REFERENCE TO RELATED APPLICATION

This application is the national stage entry of International Patent Application No. PCT/CN2014/085569, having a filing date of Aug. 29, 2014, which claims priority to and the benefit of Chinese Patent Application No. 201320615574.0 filed in the Chinese Intellectual Property Office on Sep. 30, 2013, the entire contents of which are incorporated herein by reference.

TECHNICAL FIELD

The utility model relates to a back-type expanding and opening foldable sunshade apparatus.

BACKGROUND

A sunshade tool is necessary when people go out. A common umbrella can also be used for sunshade, but is very troublesome to use because the umbrella needs to be held by a hand. Presently, there are also some backpack umbrellas jointed to a backpack or back-placed umbrellas or sunshade tools directly placed on a human body in the market. These umbrellas or similar sunshade tools are formed by only simply transferring and fixing common handheld umbrellas on the backpack or human body, which have irrational mechanism, are not attractive and practical; moreover, these tools are unable to transversely expand the sunshade width unfolded thereof, and are difficult to fold when being not in use which affect the use experience.

SUMMARY

In order to overcome the defects of the prior art, the utility model provides a back-type expanding and opening foldable sunshade apparatus, which is a sunshade apparatus able to transversely expand the sunshade width unfolded thereof.

To solve the technical problem thereof, the utility model employs a technical solution as follows.

A back-type expanding and opening foldable sunshade apparatus includes a back frame, on which an opening device with an adjustable opening/closing range is mounted. The opening device includes a rotating means able to rotate in a lockable manner, a rotation and expansion mechanism for driving the opening device to be transversely expandable, and an outer support and an inner support able to rotate with the rotating means. A flexible shade covers between the outer support and the inner support, the outer support and the inner support can fold up and open by way of transversely expanding under the drive of the rotating means and the rotation and expansion mechanism.

As an improvement of the foregoing technical solution, the rotating means includes a fixing seat as well as an outer rotating member and an inner rotating member respectively fastened and fixed with the outer support and the inner support, the inner rotating member is connected onto the inside position of the fixing seat through a rotating shaft, and the outer rotating member is connected onto the outside position of the fixing seat through a rotating shaft and the rotation and expansion mechanism transversely expandable to the position of the outer support.

As a further improvement of the foregoing technical solution, the rotation and expansion mechanism is as follows: the outer end face of the fixing seat is set into an oblique wedge surface, the top end of the oblique wedge surface is arranged at one side in front of the back frame, and the bottom end of the oblique wedge surface is arranged at one side on the back of the back frame.

As a further improvement of the foregoing technical solution, a middle rotating member driving a middle support to rotate is also arranged between the fixing seat and the outer rotating member, the middle support is fastened and installed on the middle rotating member, and is arranged between the outer support and the inner support.

Further, an over-rotating prevention mechanism is arranged between the inner rotating member or the inner support and the back frame or the fixing seat, and the over-rotating prevention mechanism limits the rotating range of the inner support at one side on the back of the back frame.

Further, the over-rotating prevention mechanism is as follows: the position of the back frame is set to be corresponding to the position of the inner support installed at one side on the back of the back frame.

Further, the inside of the outer rotating member is provided with a locating pin that locks the rotating position of the rotating means, the locating pin is installed on the outer rotating member through a spring, a non-rotating member is arranged between the outer rotating member and the middle rotating member or the fixing seat, and the locating pin is adjustably inserted into a corresponding locating hole on the non-rotating member.

Further, the inside of the outer rotating member is provided with an adjusting marble for adjusting the rotating position of the rotating means, a non-rotating member is arranged between the outer rotating member and the middle rotating member or the fixing seat, and the adjusting marble is corresponding to a marble hole on the non-rotating member.

Further, the outer support or the middle support is a single support structure formed by connecting a pair of supports with an extension sleeve.

Further, the outer support or the middle support is of a paired support structure.

The utility model has the advantageous effects that: the back-type expanding and opening foldable sunshade apparatus can be used directly on the back of a person or used together with a backpack by placing in the backpack, can adjust the opening extent and position of the shade in a lockable manner, and transversely expand the width of the shade during opening, thereby shading more effectively; and during use, the shade can be quickly opened, and when being not in use, the shade can be easily folded into a small device on the back or concealed in an interlayer of a backpack, thus being convenient and attractive.

BRIEF DESCRIPTION OF THE DRAWINGS

The utility model will be described with reference to the drawings and embodiments hereinafter.

DETAILED DESCRIPTION OF THE EMBODIMENTS

Figure 1:
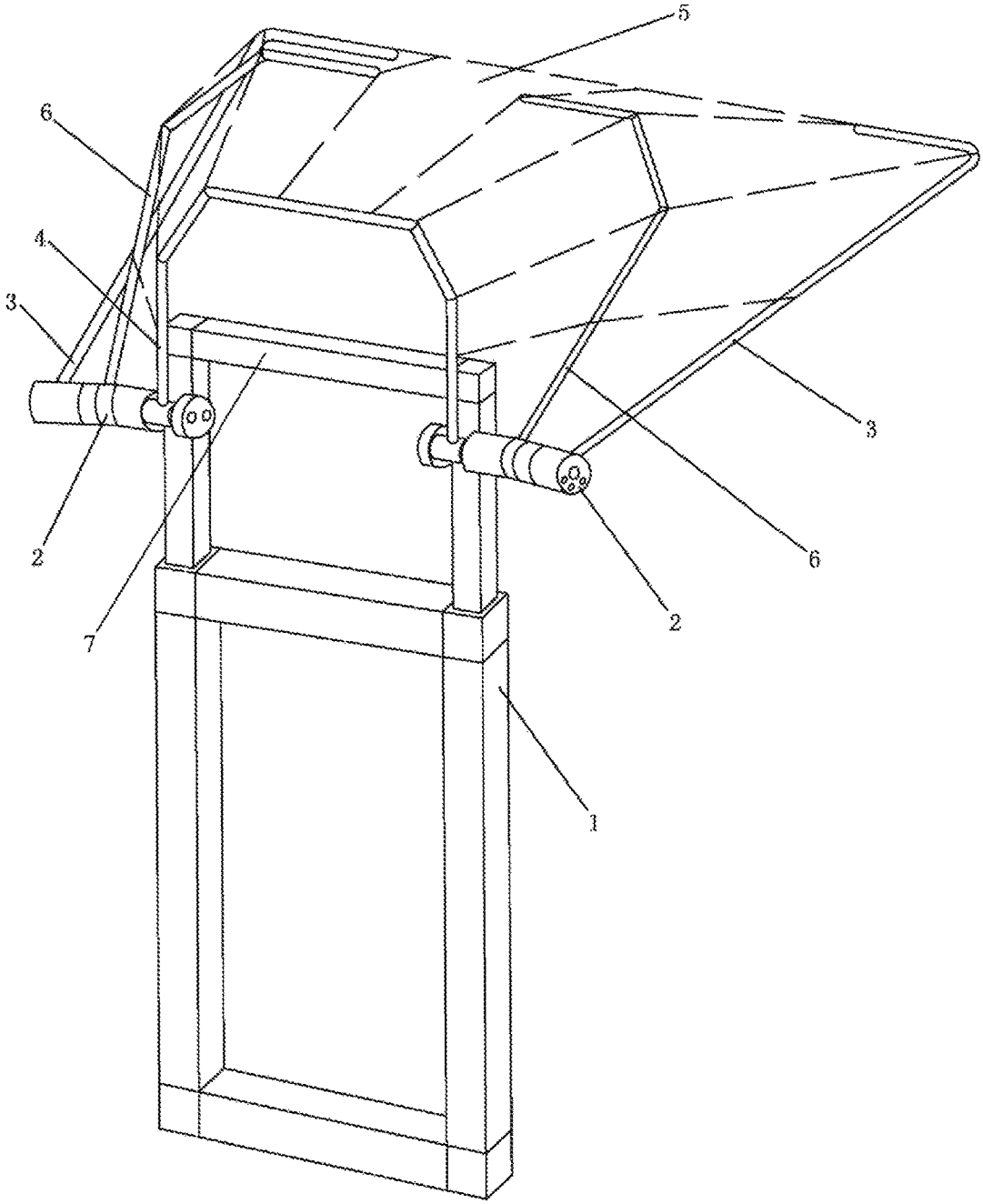
FIG. 1 is an installation structure schematic diagram according to the utility model.
Figure 2:
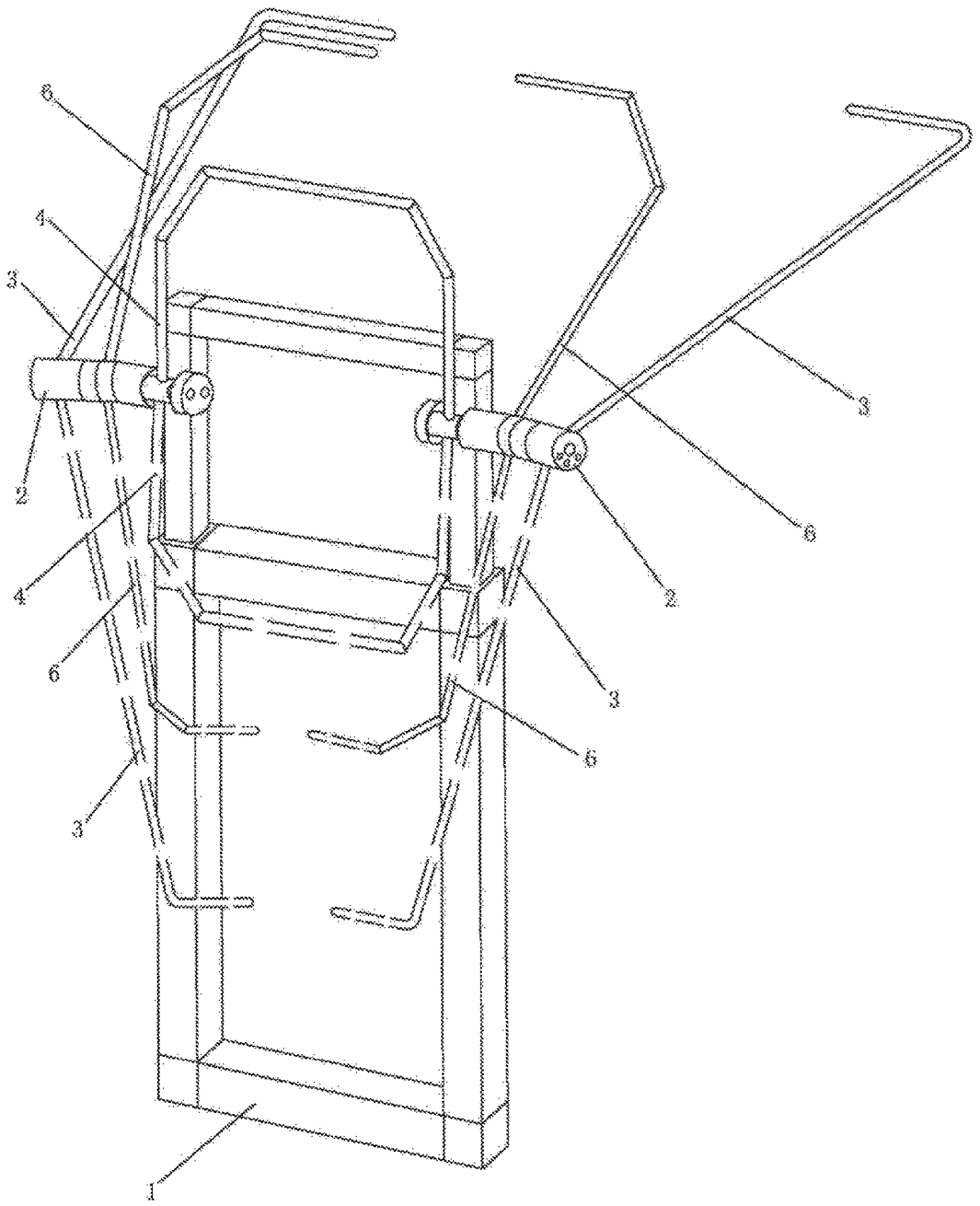
FIG. 2 is a position state schematic diagram of a support according to the utility model during opening and folding.
Figure 3:
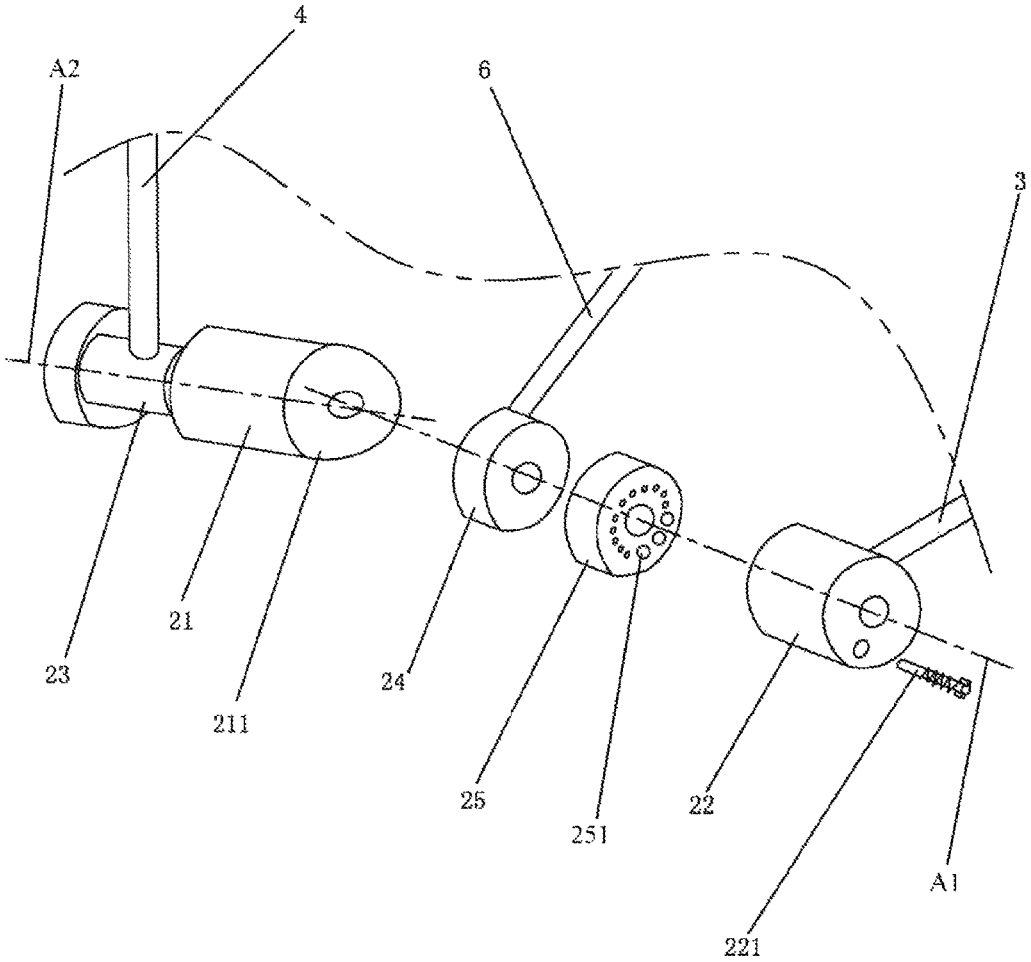
FIG. 3 is a structure exploded schematic diagram of a rotating means according to the utility model.

Referring to FIG. 1-3, a back-type foldable sunshade apparatus according to the utility model includes a back frame 1. The back frame 1 can be provided with a suspender or a connecting part in other forms so that the back frame 1 can be carried by a human body on the back. Moreover, the back frame 1 can also be designed into a single pole or multi-pole structure according to demands. An opening device with an adjustable opening/closing range is mounted on the back frame 1, the opening device includes a rotating means 2 able to rotate in a lockable manner, a rotation and expansion mechanism for driving the opening device to be transversely expandable, as well as an outer support 3 and an inner support 4 able to rotate with the rotating means 2. The rotating means 2 can be provided with a marble or locating pin to match with a corresponding locating hole or clamping groove and clamping hole, or provided with a mechanism or part in other forms to implement the functions of position adjusting and locking, so as to control the rotating positions of the outer support 3 and the inner support 4. A flexible shade 5 covers between the outer support 3 and the inner support 4, the outer support 3 and the inner support 4 can fold up and open by way of transversely expanding under the drive of the rotating means 2 and the rotation and expansion mechanism. Therefore, both the outer support 3 and the inner support 4 can be a single support or paired support form to support and drive the shade 5. Matched with the driving of the rotating means 2, the outer support 3, the inner support 4 and the shade 5 can fold up at one side on the back of the back frame 1, i.e., the side of the back frame 1 back towards the human body, or can be open to the top of one side in the front of the back frame 1, i.e., the top of one side of the back frame 1 towards the human body, so as to open and fold up the shade 5 with an adjustable opening/closing range, and to transversely expand the width of the shade 5 during opening.

As an improvement of the foregoing embodiment, the rotating means 2 preferably includes a fixing seat 21 as well as an outer rotating member 22 and an inner rotating member 23 respectively fastened and fixed with the outer support 3 and inner support 4, wherein the inner rotating member 23 is connected onto the inside position of the fixing seat 21 through a second rotating shaft A2, and the outer rotating member 22 is connected onto the outside position of the fixing seat 21 through a first rotating shaft A1 and the rotation and expansion mechanism transversely expandable to the position of the outer support 3. Because the outer support 3 and the inner support 4 are respectively installed on the outer rotating member 22 and the inner rotating member 23, the rotating means 2 can be separately installed on the left and right of the back frame 1, and make the outer rotating member 22 connect with the inner rotating member 23 through a single rotating shaft, so as to implement single pole rotating operation; or the rotating means 2 at the two sides of the back frame 1 can be respectively provided with a rotating shaft to implement rotating operation. The rotation and expansion mechanism can provide a cross travel for the outer rotating member 22 in a manner of spiral moving or stretching moving or the like, and also can open towards the outside through an oblique outer support 3, so as to change the straight travel of the outer support 3 into an oblique expansion travel, promote the expanding and opening of the shade 5, and widen the transverse coverage area of the shade 5 during rotating and opening the outer support 3 and the inner support 4; and fold up the outer support 3 and the inner support 4 together with the shade 5 to one side on the back of the back frame 1, i.e., one side of the back frame 1 back towards the human body, during rotating and folding up the outer support 3 and the inner support 4, so as to reduce space occupation. Moreover, in order to keep the shade 5 folded up by the outer support 3, supports in pairs at the two sides may also be employed and connected with an extension sleeve to form a single support.

As a further improvement of the foregoing embodiment, in the rotation and expansion mechanism, preferably, the outer end face of the fixing seat 21 is set into an oblique wedge surface 211, the top end of the oblique wedge surface 211 is arranged at one side in front of the back frame 1, i.e., one side of the back frame 1 towards the human body, and the bottom end of the oblique wedge surface 211 is arranged at one side on the back of the back frame 1, i.e., one side of the back frame 1 back towards the human body, so as to expand the outer support 3 outwards during the rotating and opening.

As a further improvement of the foregoing embodiment, preferably, a middle rotating member 24 driving a middle support 6 to rotate is also arranged between the fixing seat 21 and the outer rotating member 22, wherein the middle support 6 is fastened and installed on the middle rotating member 24, and is arranged between the outer support 3 and the inner support 4, and the support of the shade 5 is reinforced by the middle support 6, so as to increase the intensity of the shade 5 during opening.

Further, an over-rotating prevention mechanism 7 (see FIG. 1) is arranged between the inner rotating member 23 or the inner support 4 and the back frame 1 or the fixing seat 21, and the over-rotating prevention mechanism 7 limits the rotating range of the inner support 4 at one side on the back of the back frame 1, i.e., one side of the back frame 1 back towards the human body; when the opening device opens the shade 5, the inner support 4 is limited in one side on the back of the back frame 1, so that the inner support will not rotate with the outer support 3 to cross over the back frame 1 to one side in the front of the back frame.

As a further improvement of the foregoing embodiment, in the over-rotating prevention mechanism 7, the position of the back frame 1 is set to be corresponding to the position of the inner support 4 installed at one side on the back of the back frame 1, so as to prevent over-rotation of the inner support 4, and skillfully use the back frame 1 to directly limit the rotating range of the inner support 4, without needing an extra part.

Further, the inside of the outer rotating member 22 is provided with a locating pin 221 that locks the rotating position of the rotating means 2, the locating pin 221 is installed on the outer rotating member 22 through a spring, a non-rotating member 25 is arranged between the outer rotating member 22 and the middle rotating member 24 or the fixing seat 21, and the locating pin is adjustably inserted into a corresponding locating hole 251 on the non-rotating member 25.

Figure 4:
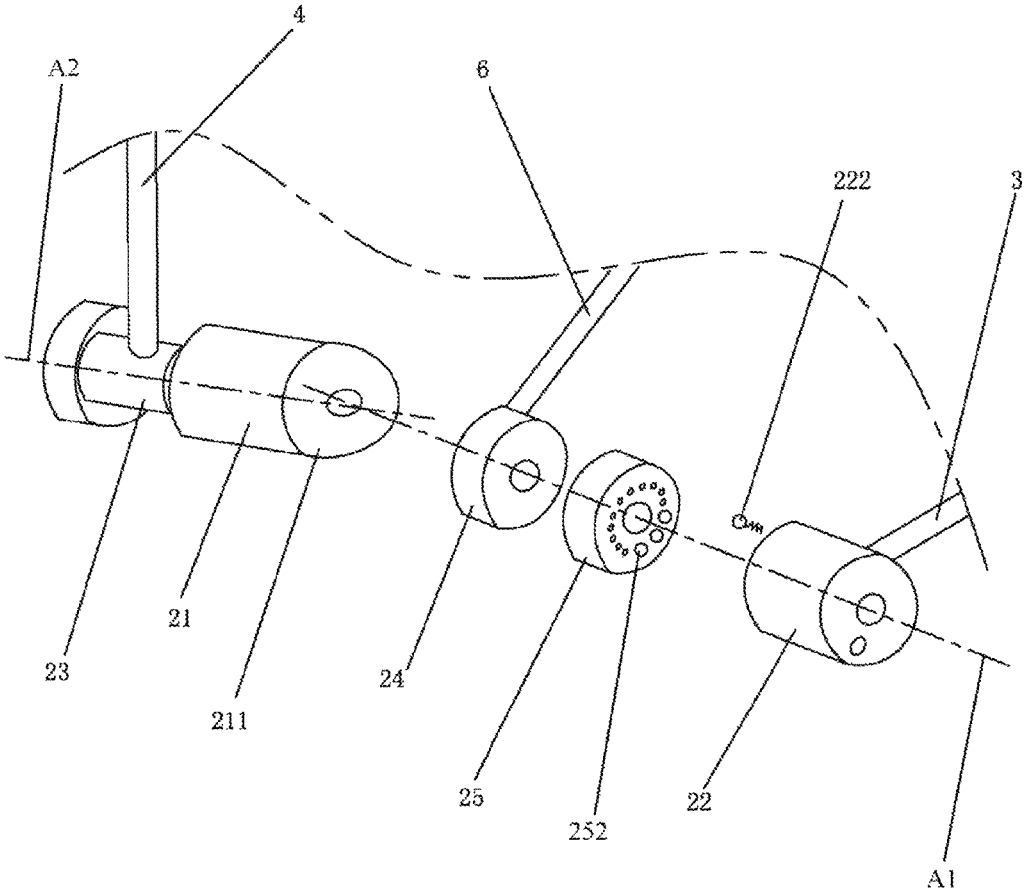
FIG. 4 is another structure exploded schematic diagram of a rotating means according to the utility model.

Further, referring to FIG. 4, the inside of the outer rotating member 22 is provided with an adjusting marble 222 for adjusting the rotating position of the rotating means 2, a non-rotating member 25 is arranged between the outer rotating member 22 and the middle rotating member 24 or the fixing seat 21, and the adjusting marble 222 is corresponding to a marble hole 252 on the non-rotating member 25.

Further, the outer support 3 or the middle support 6 is a single support structure formed by connecting a pair of supports with an extension sleeve.

Further, the outer support 3 or the middle support 6 is of a paired support structure.

The above only describes preferred embodiments of the utility model, but the utility model is not limited to the foregoing embodiments. Any technical effect of the utility model achieved with any same or similar means shall all fall within the protection scope of the utility model.

The invention claimed is:

1. A back-type expanding and opening foldable sunshade apparatus, characterized in that: the apparatus comprises a back frame, on which an opening device with an adjustable opening/closing range is mounted; the opening device comprises a rotating means able to rotate in a lockable manner, a rotation and expansion mechanism for driving the opening device to be transversely expandable, and an outer support and an inner support able to rotate with the rotating means; a flexible shade covers between the outer support and the inner support; and the outer support and the inner support can fold up and open by way of transversely expanding under the drive of the rotating means and the rotation and expansion mechanism, wherein the rotating means comprises an outer rotating member and an inner rotating member, wherein the outer support is fastened and fixed to the outer rotating member and the inner support is fastened and fixed to the inner rotating member, wherein a first rotating shaft of the outer rotating member is intersected with a second rotating shaft of the inner rotating member, and wherein the rotation and expansion mechanism provides a cross travel for the outer support and inner support in a manner including spiral moving or stretching moving.

2. The back-type expanding and opening foldable sunshade apparatus according to claim 1, characterized in that: the rotating means comprises a fixing seat; the inner rotating member is connected onto an inside position of the fixing seat through the second rotating shaft; and the outer rotating member is connected onto an outside position of the fixing seat through the first rotating shaft and the rotation and expansion mechanism transversely expandable to the position of the outer support.

3. The back-type expanding and opening foldable sunshade apparatus according to claim 2, characterized in that: in the rotation and expansion mechanism, an outer end face of the fixing seat is set into an oblique wedge surface, a top end of the oblique wedge surface is arranged at one side in front of the back frame, and a bottom end of the oblique wedge surface is arranged at one side on the back of the back frame.

4. The back-type expanding and opening foldable sunshade apparatus according to claim 3, characterized in that: a middle rotating member driving a middle support to rotate is also arranged between the fixing seat and the outer rotating member; and the middle support is fastened and installed on the middle rotating member, and is arranged between the outer support and the inner support.

5. The back-type expanding and opening foldable sunshade apparatus according to claim 4, characterized in that: the inside of the outer rotating member is provided with a locating pin that locks the rotating position of the rotating means, the locating pin is installed on the outer rotating member through a spring; a non-rotating member is arranged between the outer rotating member and the middle rotating member or the fixing seat; and the locating pin is adjustably inserted into a corresponding locating hole on the non-rotating member.

6. The back-type expanding and opening foldable sunshade apparatus according to claim 4, characterized in that: the inside of the outer rotating member is provided with an adjusting marble for adjusting the rotating position of the rotating means; a non-rotating member is arranged between the outer rotating member and the middle rotating member or the fixing seat; and the adjusting marble is corresponding to a marble hole on the non-rotating member.

7. The back-type expanding and opening foldable sunshade apparatus according to claim 4, characterized in that the outer support or the middle support is of a paired support structure.

8. The back-type expanding and opening foldable sunshade apparatus according to claim 2, characterized in that: an over-rotating prevention mechanism is arranged between the inner rotating member or the inner support and the back frame or the fixing seat; and the over-rotating prevention mechanism limits the rotating range of the inner support at one side on the back of the back frame.

9. The back-type expanding and opening foldable sunshade apparatus according to claim 8, characterized in that: in the over-rotating prevention mechanism, the position of the back frame is set to be corresponding to the position of the inner support installed at one side on the back of the back frame.

* * * * *